US006283811B1

(12) United States Patent
Peterson

(10) Patent No.: US 6,283,811 B1
(45) Date of Patent: Sep. 4, 2001

(54) STEERABLE INFLATABLE TOWABLE VEHICLE

(75) Inventor: Leroy L. Peterson, Omaha, NE (US)

(73) Assignee: Sportsstuff Inc., Omaha ( * ) Notice: Subject to any disclaimer, the term of this patent is extended or adjusted under 35 U.S.C. 154(b) by 0 days.

(21) Appl. No.: 09/574,197

(22) Filed: May 18, 2000

(51) Int. Cl.[7] ..... B63B 1/00
(52) U.S. Cl. ..... 441/66; 441/67; 114/345
(58) Field of Search ..... 441/65, 66, 67, 441/79, 129, 131; 114/126, 345, 346; D21/803, 809

(56) References Cited

U.S. PATENT DOCUMENTS

| | | | | |
|---|---|---|---|---|
| D. 428,464 | * | 7/2000 | Peterson | D21/803 |
| D. 435,239 | * | 12/2000 | Peterson | D21/803 |
| D. 435,619 | * | 12/2000 | Peterson | D21/803 |
| D. 435,620 | * | 12/2000 | Peterson | D21/803 |
| 3,380,090 | * | 4/1968 | Kenmuir | 114/357 |
| 3,455,571 | * | 7/1969 | Dallera et al. | 280/18 |
| 3,626,428 | * | 12/1971 | Collaro | 441/65 |
| 3,670,349 | * | 6/1972 | Moore | 441/125 |
| 3,824,945 | * | 7/1974 | Casciano | 114/246 |
| 3,959,835 | * | 6/1976 | Nos | 5/706 |
| 4,302,858 | * | 12/1981 | Casciano | 441/65 |
| 4,389,961 | * | 6/1983 | Parish | 114/345 |
| 4,619,620 | * | 10/1986 | Felter | 441/66 |
| 4,807,554 | * | 2/1989 | Hung | 114/345 |
| 5,655,939 | * | 8/1997 | Salvadores | 441/65 |
| 5,672,057 | * | 9/1997 | Engel | 434/84 |
| 5,702,278 | * | 12/1997 | Boucher | 441/66 |
| 6,012,778 | * | 1/2000 | Peterson | 297/452.41 |
| 6,171,161 | * | 1/2001 | Peterson | 441/130 |
| 6,185,765 | * | 2/2001 | High | 5/419 |

FOREIGN PATENT DOCUMENTS

| | | | | |
|---|---|---|---|---|
| 974821 | * | 9/1975 | (CA) | 441/65 |
| 2545232 | * | 4/1977 | (DE) | 441/74 |
| 2240859 | * | 3/1975 | (FR) | 441/129 |

* cited by examiner

*Primary Examiner*—S. Joseph Morano
*Assistant Examiner*—Ajay Vasudeva
(74) *Attorney, Agent, or Firm*—Henderson & Sturm LLP

(57) ABSTRACT

A steerable towable vehicle including a body member with a pair of fore-and-aft directed laterally spaced fins attached to the bottom surface. A towing line is attached to the bottom surface at a point centered between the fins adjacent the front of the fins. A passenger carried on the top surface of the body member can shift their weight to one side or the other of the towing line attachment point to selectively steer the vehicle to the right or left. Hand grips are provided to assist the passenger in effectively shifting their weight to steer the vehicle.

20 Claims, 2 Drawing Sheets

STEERABLE INFLATABLE TOWABLE VEHICLE

BACKGROUND OF THE INVENTION

1. Field of the Invention

The present invention relates to the field of recreational vehicles, and more particularly to a steerable inflatable towable vehicle.

2. Description of Related Art

The prior art is replete with myriad and diverse towable recreational vehicles. While all of the aforementioned prior art constructions are more than adequate for the basic purpose and function for which they have been specifically designed, they are uniformly deficient with respect to their failure to provide a simple, efficient, and practical steerable inflatable towable vehicle.

As a consequence of the foregoing situation, there has existed a longstanding need for a new and improved recreational vehicle, and the provision of such a construction is a stated objective of the present invention.

BRIEF SUMMARY OF THE INVENTION

Briefly stated, the present invention provides a steerable towable vehicle including a body member with a pair of fore-and-aft directed laterally spaced fins attached to the bottom surface. A towing line is attached to the bottom surface at a point centered between the fins adjacent the front of the fins. A passenger carried on the top surface of the body member can shift their weight to one side or the other of the towing line attachment point to selectively steer the vehicle to the right or left. Hand grips are provided to assist the passenger in effectively shifting their weight to steer the vehicle.

BRIEF DESCRIPTION OF THE SEVERAL VIEWS OF THE DRAWINGS

These and other attributes of the invention will become more clear upon a thorough study of the wing description of the best mode for carrying out the invention, particularly when reviewed in conjunction with the drawings, wherein.

DETAILED DESCRIPTION OF THE INVENTION

Figure 1:
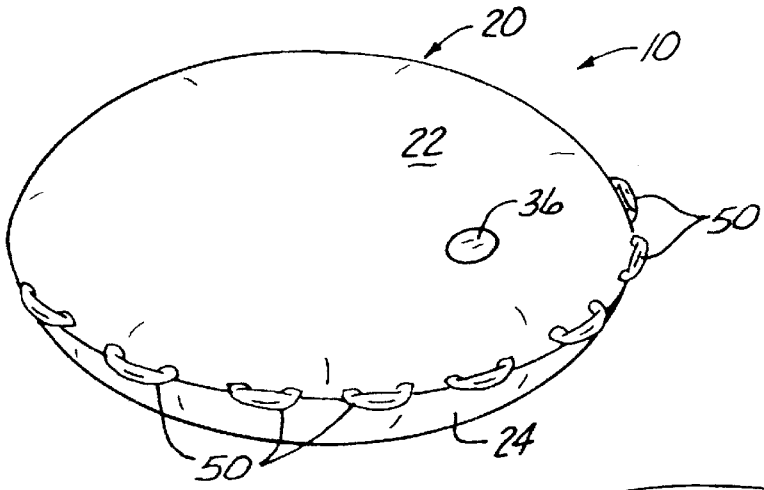
FIG. 1 is a top perspective view of the steerable towable vehicle of the present invention.
Figure 2:
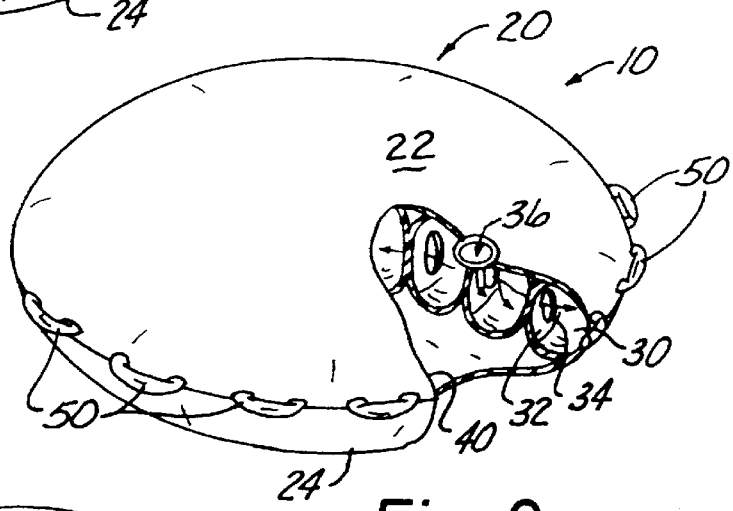
FIG. 2 is a top perspective view with portions cut away to show the inflatable concentric rings of the body member.
Figure 3:
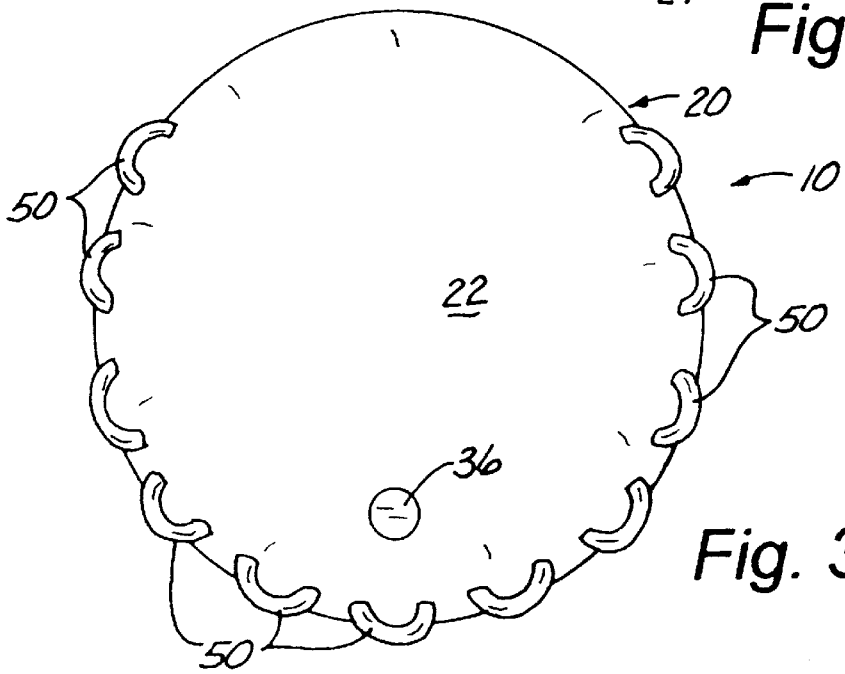
FIG. 3 is a top plan view of the vehicle.

As can be seen by reference to the drawings, and in particular to FIG. 1, the steerable vehicle that forms the basis of the present invention is designated generally by the reference number 10. The vehicle 10 includes a body member 20 having substantially horizontal top and bottom surfaces 22, 24. As best illustrated in FIG. 2, the body member includes a number of concentrically disposed inflatable rings 30 having common walls 32 with openings 34 therein to facilitate inflation through a single inflation valve 36. The rings 30 have progressively decreasing cross-sectional diameters that results in the outwardly tapered low profile appearance of the vehicle 10. A protective shell 40 made of nylon or another suitable material enclosed the inflatable rings 30. The outer edge of the top surface 22 carries a number of passenger hand grips 50.

Figure 4:
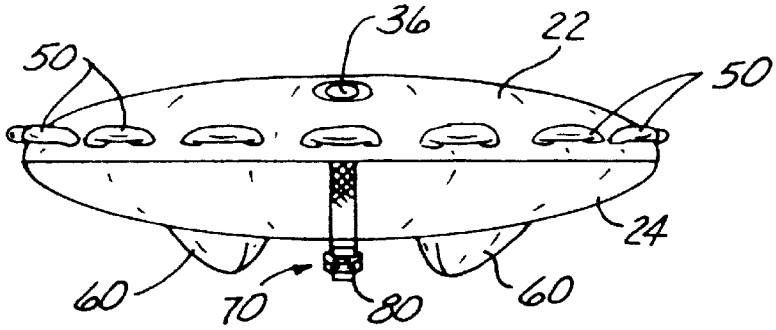
FIG. 4 is a front elevational view thereof.
Figure 5:
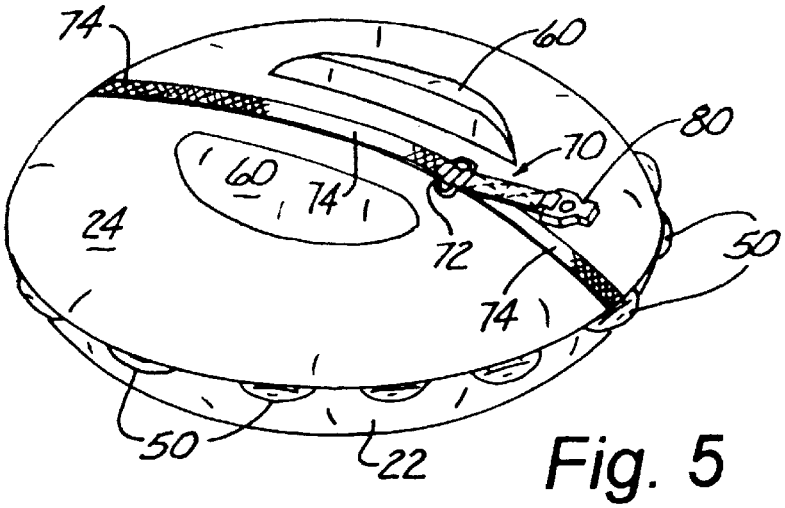
FIG. 5 is a bottom perspective view showing the fore-and-aft laterally spaced fins and the towing line.
Figure 6:
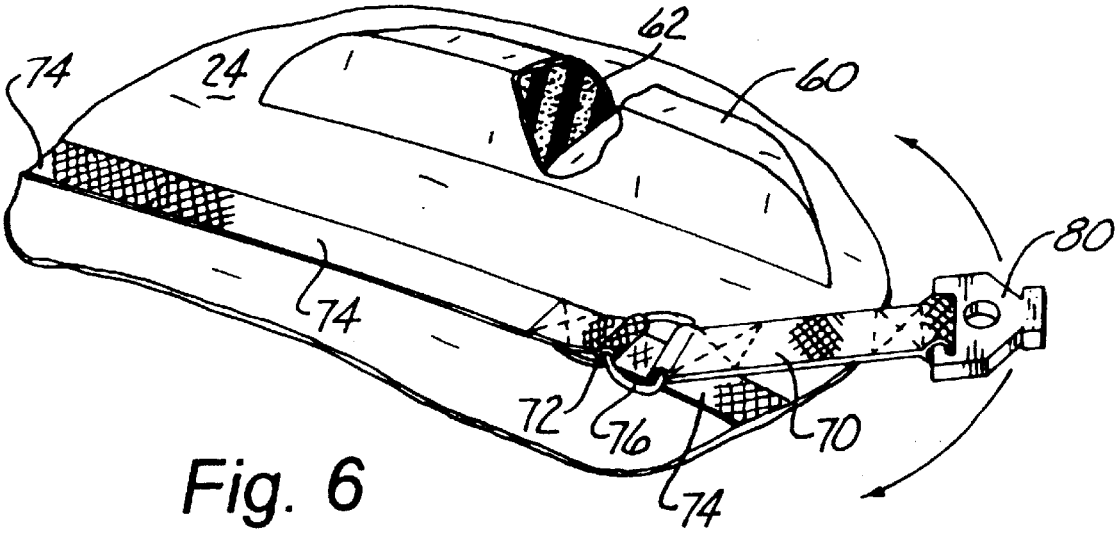
FIG. 6 is a partial perspective view with portions cut away to illustrate the construction of the fins.

As shown in FIGS. 4–6, the bottom surface 24 carries a pair of fore-and-aft directed laterally spaced fins 60 having a generally planer interior surface and a generally curved exterior surface.

In use, the passenger supported on the top surface 22 shifts their weight to one side or the other of the towing line attachment point 72 to selectively steer the vehicle 10 to the right or to the left. The hand grips 50 are used by the passenger to assist in effectively shifting their weight.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A steerable towable vehicle, comprising:

a body member including a generally horizontal and circular top surface and bottom surface;

a pair of fore-and-aft directed laterally spaced fins attached to the bottom surface, each fin having a front and a rear; and a towing line attached to the bottom surface at a point of attachment disposed between the fins and adjacent the fronts thereof.

2. The vehicle of claim 1 wherein the towing line point of attachment is centered between the fins.

3. The vehicle of claim 1 further including a plurality of passenger hand grips attached to the top surface of the body member.

4. The vehicle of claim 1 wherein the body member includes a plurality of concentrically disposed inflatable rings enclosed in a protective shell.

5. The vehicle of claim 4 wherein the concentric rings have cross sectional diameters which progressively decrease from the center of the body member to a outer periphery of the body member.

6. The vehicle of claim 5 wherein each adjacent concentric ring includes a common wall with openings, and the adjacent concentric rings are in fluid communication with each other.

7. The vehicle of claim 6 wherein a single inflation valve is disposed in fluid communication with all of the concentric rings.

8. The vehicle of claim 5 wherein the body member has an outwardly tapered profile.

9. A steerable towable vehicle, comprising:

a body member including a generally horizontal top and bottom surface; a center and an outer periphery a pair of fore-and-aft directed laterally spaced fins attached to the bottom surface, each fin having a front, a rear, and a generally planar inner surface and a generally curved outer surface a towing line attached to the bottom surface at a point of attachment adjacent the front of the pair of fins.

10. The vehicle of claim 9 wherein the towing line point of attachment is centered between the fins.

11. The vehicle of claim 9 wherein the body member includes a plurality of concentrically disposed inflatable rings enclosed in a protective shell.

12. The vehicle of claim 11 wherein the concentric rings have cross sectional diameters which progressively decrease from the center to the outer periphery of the body member.

13. The vehicle of claim 11 wherein each adjacent concentric ring includes a common wall with openings, and the adjacent concentric rings are in fluid communication with each other.

14. The vehicle of claim 13 wherein a single inflation valve is disposed in fluid communication with all of the concentric rings.

15. A steerable towable vehicle, comprising:

a body member including a generally horizontal top and bottom surface, a center and an outer periphery and including a plurality of concentrically disposed inflatable rings enclosed in a protective shell wherein the concentric rings have cross sectional diameters which progressively decrease from the center to the outer periphery of the body member a pair of fore-and-aft directed laterally spaced fins attached to the bottom surface, each fin having a front and a rear; and a towing line attached to the bottom surface at a point of attachment adjacent the front of the pair of fins.

16. The vehicle of claim 15 wherein the towing line point of attachment is centered between the fins.

17. The vehicle of claim 16 wherein a single inflation valve is disposed in fluid communication with all of the concentric rings.

18. The vehicle of claim 15 further including a plurality of passenger hand grips attached to the top surface of the body member.

19. The vehicle of claim 15 wherein each adjacent concentric ring includes a common wall with openings, and the adjacent concentric rings are in fluid communication with each other.

20. The vehicle of claim 15 wherein the body member has an outwardly tapered profile.

* * * * *